US007530867B2

(12) United States Patent
Jackson

(10) Patent No.: US 7,530,867 B2
(45) Date of Patent: May 12, 2009

(54) PORTABLE CANOE PROPULSION SYSTEM

(76) Inventor: Reinhard Erwin Jackson, 122 Nicholson's Point RR#3, Bath, ON (CA) K0H 1G0

( * ) Notice: Subject to any disclaimer, the term of this patent is extended or adjusted under 35 U.S.C. 154(b) by 49 days.

(21) Appl. No.: 10/581,095

(22) PCT Filed: Nov. 29, 2004

(86) PCT No.: PCT/CA2004/002052

§ 371 (c)(1),
(2), (4) Date: May 31, 2006

(87) PCT Pub. No.: WO2005/051761

PCT Pub. Date: Jun. 9, 2005

(65) Prior Publication Data

US 2007/0032145 A1 Feb. 8, 2007

(51) Int. Cl.
*B63H 16/20* (2006.01)
*B63H 16/00* (2006.01)

(52) U.S. Cl. ..... 440/30; 440/21; 440/28; 440/29

(58) Field of Classification Search ..... 440/28, 440/30, 21, 29
See application file for complete search history.

(56) References Cited

U.S. PATENT DOCUMENTS 1,246,729 A 11/1917 Dresher
2,612,859 A 10/1952 Billman et al.
2,940,415 A 6/1960 Schwarzer
2,983,245 A * 5/1961 Ambrose ..... 440/31
3,377,976 A 4/1968 Gustine
4,427,392 A 1/1984 Schneider
4,676,755 A 6/1987 Yagan
4,891,024 A 1/1990 Benjamin
4,943,251 A 7/1990 Lerach et al.
5,168,825 A * 12/1992 Ring ..... 114/363
5,217,398 A 6/1993 Meron et al.
5,282,762 A 2/1994 Cerreto
5,295,878 A * 3/1994 Guidry ..... 440/28
5,374,206 A 12/1994 Gregory
6,083,065 A 7/2000 Hall
6,165,030 A * 12/2000 Lewis ..... 440/30
6,905,379 B1 * 6/2005 Jackson ..... 440/30

FOREIGN PATENT DOCUMENTS

CA 2308263 11/2001

* cited by examiner

*Primary Examiner*—S. Joseph Morano
*Assistant Examiner*—Daniel V Venne

(57) ABSTRACT

A portable pedal driven propulsion device for a small watercraft (1) in which power from crank operated pedals (5) is transmitted to a pivotally mounted gearbox (32) or pulley system (81,82,83) adjacent the operator. A longitudinal drive shaft (2) is connected, at one end, to the gearbox (32) or pulley system (81,82,83) and, at the other end, to a propeller (40) such that the drive shaft (2) and propeller (40) can be moved selectively between a raised inoperative position and a lowered operative position.

4 Claims, 13 Drawing Sheets

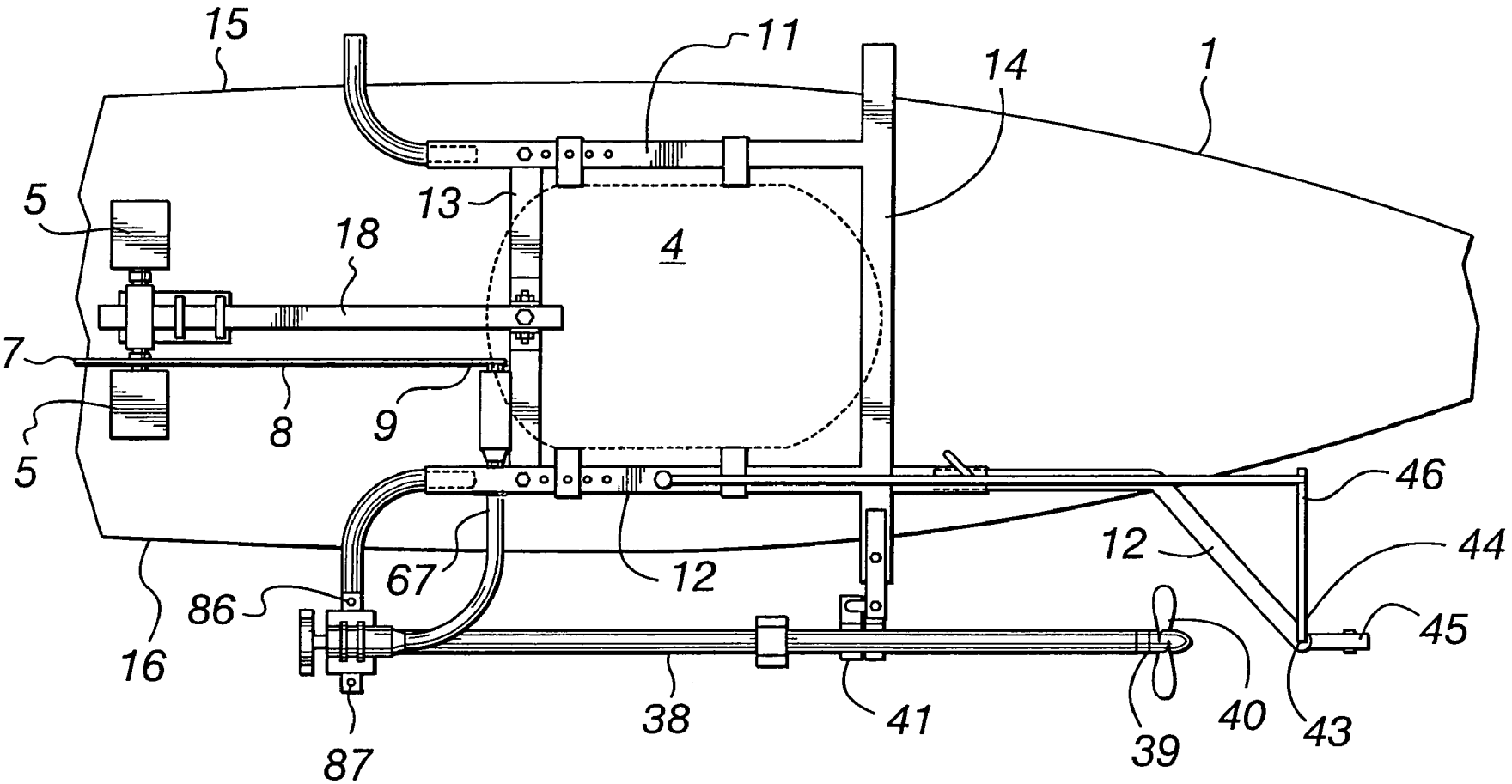
FIG. 12
Replacement Sheet
US Appln. No. 10/581,095

PORTABLE CANOE PROPULSION SYSTEM

RELATED APPLICATIONS

This is the U.S. National Phase under 35 U.S.C. § 371 of International Application No. PCT/CA2004/002052, filed Nov. 29, 2004, which in turn claims the benefit of U.S. patent application Ser. No. 10/722,399, filed Nov. 28, 2003, the disclosures of which Applications are incorporated by reference herein.

FIELD OF INVENTION

This invention relates to a portable propulsion device for use in a small watercraft such as a canoe. More particularly, this invention relates a portable pedal and seat device for driving an outboard propeller pivotally mounted alongside the canoe for movement between an operative position wherein the propeller is in the water and an inoperative position wherein the propeller is out of the water and the propeller drive shaft is in a plane parallel to the gunwale of the canoe.

BACKGROUND OF INVENTION

Pedal operated watercraft, such as canoes, are well known in the art and there are numerous patents directed to specific features thereof. Such devices generally comprise a frame structure, with or without a seat, having a pedal crank and sprocket system connected, by way of a chain, to a drive shaft which drives, via a series of gears and pinions, a vertically mounted drive shaft at the stern of the watercraft which in turn drives a propeller mounted on a horizontal axis. Such devices are relatively complex and involve a long gear train which is inherently expensive. The rigidly mounted vertical shaft at the stern to drive the propeller implies that the propeller is at a fixed depth relative to the keel of the watercraft, and it is difficult, if not impossible, for a canoeist to turn around in a relatively unstable canoe to reach the vertically mounted drive shaft at the stern so as to raise the propeller out of the water when not in use or in shallow water. There is a need, therefore, for a simple pedal operated propulsion system in which the propeller can be raised or lowered easily by the canoeist without moving from his seat or even turning to face the rear of the canoe. Preferably, the canoeist should be seated as low as possible in the canoe for stability reasons and the pedal device should incorporate both the seat and the crank mechanism and should be simply placed across the gunwales of the canoe without needing clamps, bolts or other devices to secure it in place.

SUMMARY OF THE INVENTION

It is an object of the present invention to provide a portable crank-operated, propeller driven, propulsion system for use in a canoe or other small watercraft, in which the propeller is mounted on a propeller shaft which can be raised to, or lowered from, a substantially horizontal position parallel to the gunwale of the canoe to an operative position in which the propeller shaft is at an acute angle relative to the gunwale and the propeller is at any selected depth in the water.

As a first aspect of this invention, there is provided a portable, pedal driven propeller and drive shaft apparatus for use in a watercraft having gunwales, characterised by:

(a) a substantially quadrilateral frame adapted to be releasably mounted on the gunwales of the watercraft;

(b) operator seat means mounted on the quadrilateral frame;

(c) pedal crank means mounted forwardly of, and depending from, the quadrilateral frame and operable by an operator sitting on the seat means;

(d) a gear box pivotally mounted on the quadrilateral frame so as to lie to one side of the operator seat means and forward thereof when in operative position;

(e) means to transmit motive power generated by the pedal crank means to the gear box, the means to transmit motive power comprising first drive means operatively connected to the pedal crank means and to a first end of a first transverse drive shaft, second drive means operatively connected to a second end of the first transverse drive shaft, a second transverse drive shaft means, operatively connected at a first end thereof to the second drive means and operatively connected at a second end thereof to the gear box; and (f) longitudinal drive shaft means comprising a longitudinal shaft operatively connected at a first end thereof to the gear box and, at a second end thereof, to propeller means;

the gear box and longitudinal drive shaft means being adapted to be pivoted, when mounted on the watercraft, about a horizontal transverse axis so as to raise the propeller means to an inoperable position wherein the longitudinal drive shaft means is substantially parallel to the gunwales, and lower the propeller means to an operative position wherein the longitudinal drive shaft means is at an acute angle relative to the gunwales.

As a second aspect of the invention, there is further provided a portable, pedal driven propeller and drive shaft apparatus for use in a watercraft having gunwales, characterised by:

(a) a substantially quadrilateral frame adapted to be releasably mounted on the gunwales of the watercraft;

(b) operator seat means mounted on the quadrilateral frame (c) pedal crank means mounted forwardly of, and depending from, the quadrilateral frame and operable by an operator sitting on the seat means;

(d) pulley means pivotally mounted on the quadrilateral frame so as to lie to one side of the operator seat means and forward thereof when in operative position;

(e) means to transmit motive power generated by the pedal crank means to the pulley means, the means to transmit motive power comprising drive means, a transverse drive shaft and flexible cable-drive means, the drive means being operatively connected to the pedal crank means and to a first end of the transverse drive shaft, and the flexible cable-drive means being operatively connected at a first end thereof to a second end of the transverse drive shaft, and, at a second end thereof, to the pulley means; and (f) longitudinal drive shaft means comprising a longitudinal shaft operatively connected at a first end thereof to the pulley means and, at a second end thereof, to propeller means;

the pulley means and longitudinal drive shaft means being adapted to be pivoted, when mounted on the watercraft, about a horizontal transverse axis so as to raise the propeller means to an inoperable position wherein the longitudinal drive shaft means is substantially parallel to the gunwales, and lower the propeller means to an operative position wherein the longitudinal drive shaft means is at an acute angle relative to the gunwales.

BRIEF DESCRIPTION OF DRAWINGS

Embodiments of the present invention will be further described, by way of example, with reference to the accompanying drawings, in which:

FIG. 12 is a top plan view of a second embodiment of the present invention;

DETAILED DESCRIPTION OF PREFERRED EMBODIMENTS

Figure 1:
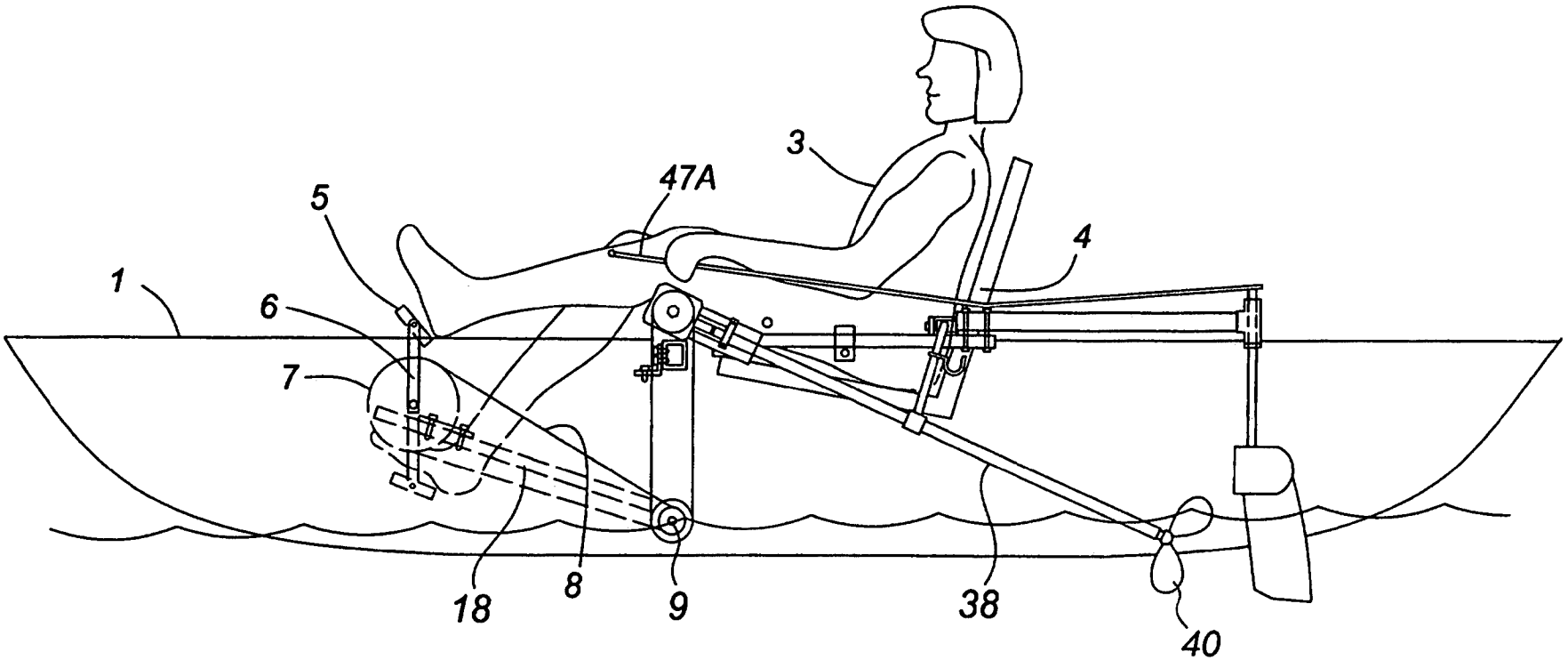
FIG. 1 is an isometric side view of one embodiment of the present invention, mounted on a canoe.
Figure 2:
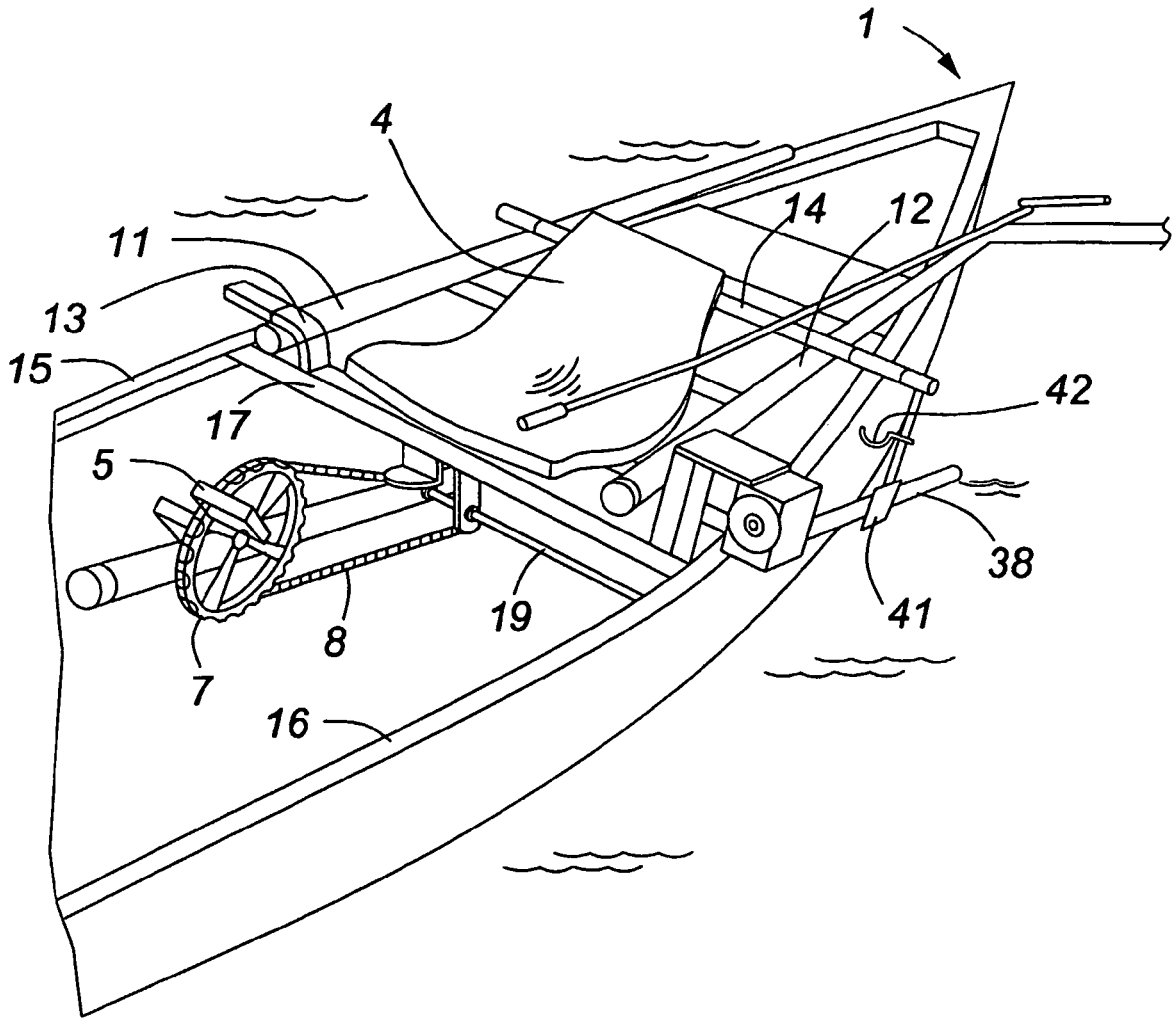
FIG. 2 is an oblique isometric front view of the embodiment shown in FIG. 1.
Figure 3:
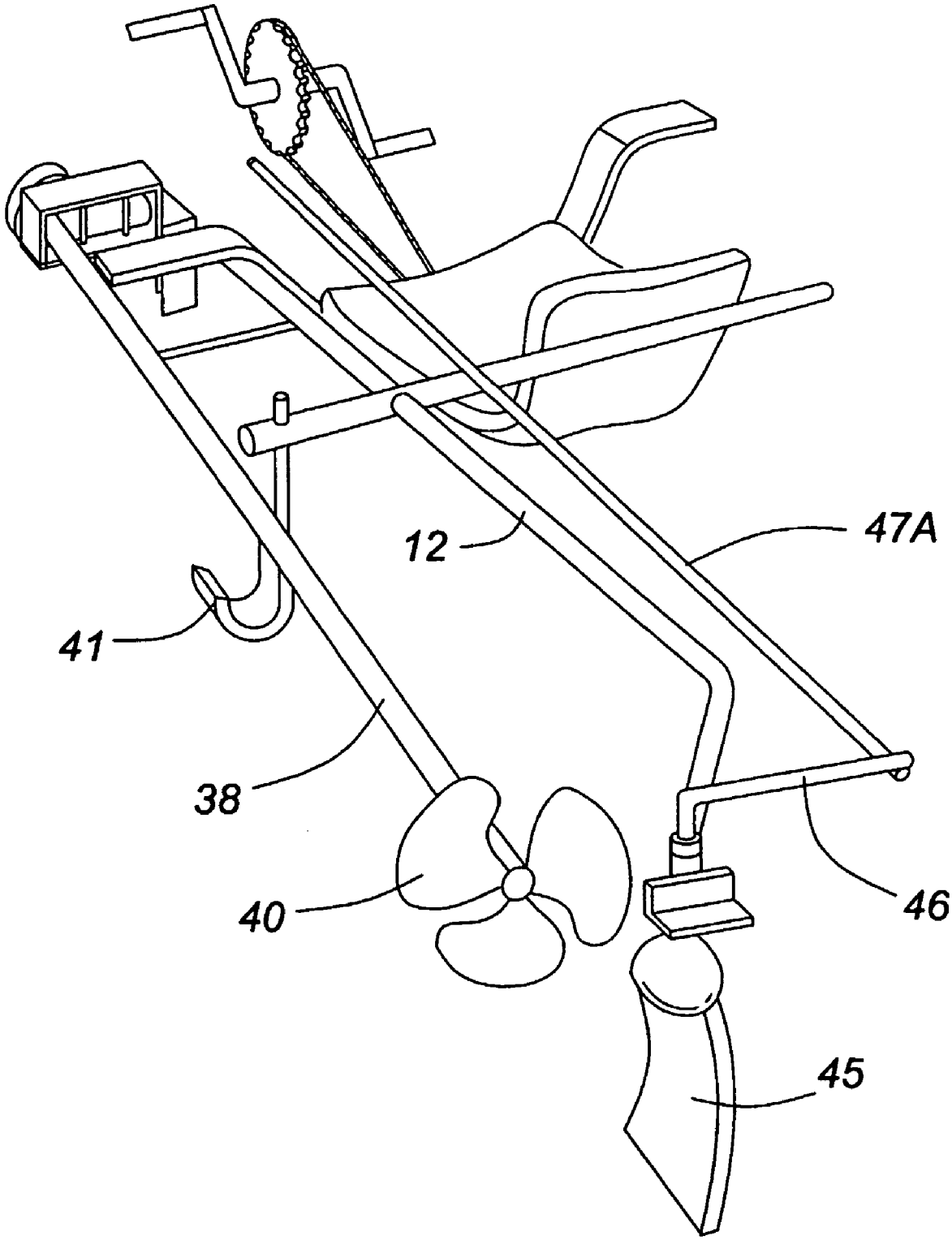
FIG. 3 is an oblique isometric rear view of the embodiment shown in FIG. 1.
Figure 4:
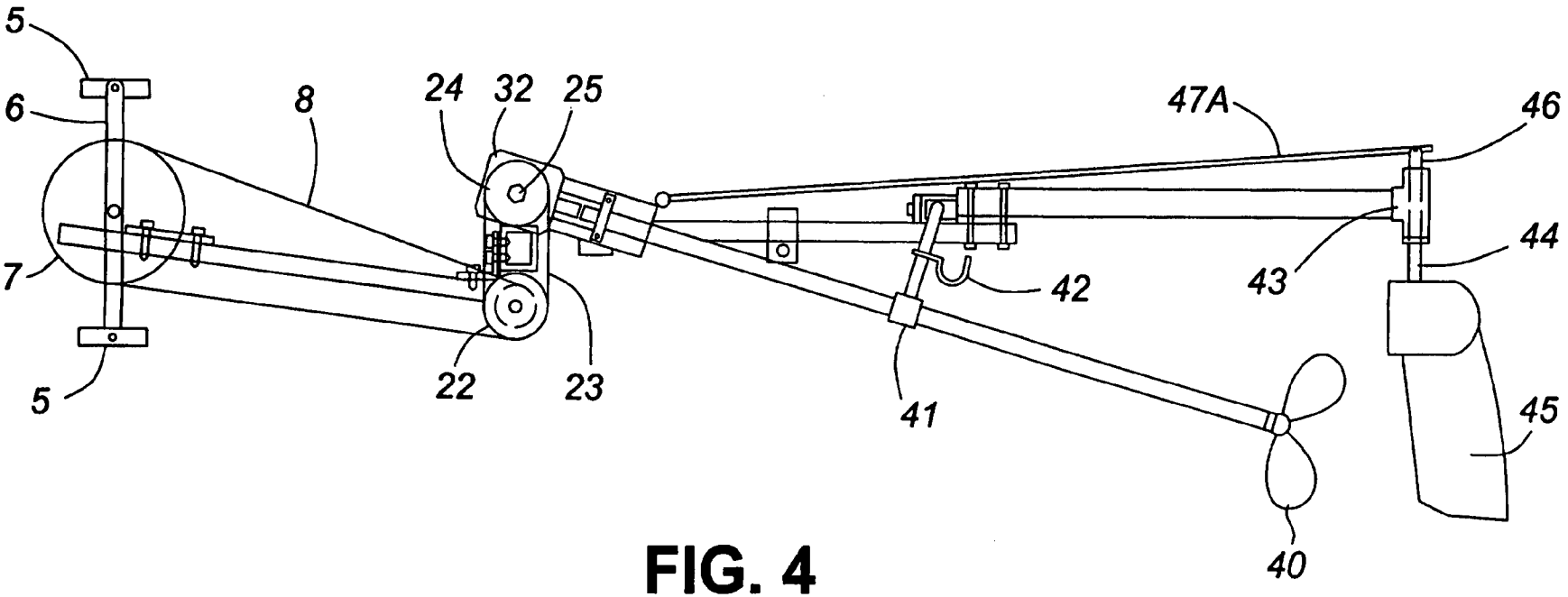
FIG. 4 is a side view, partly in section, of the embodiment shown in FIG. 1.
Figure 5:
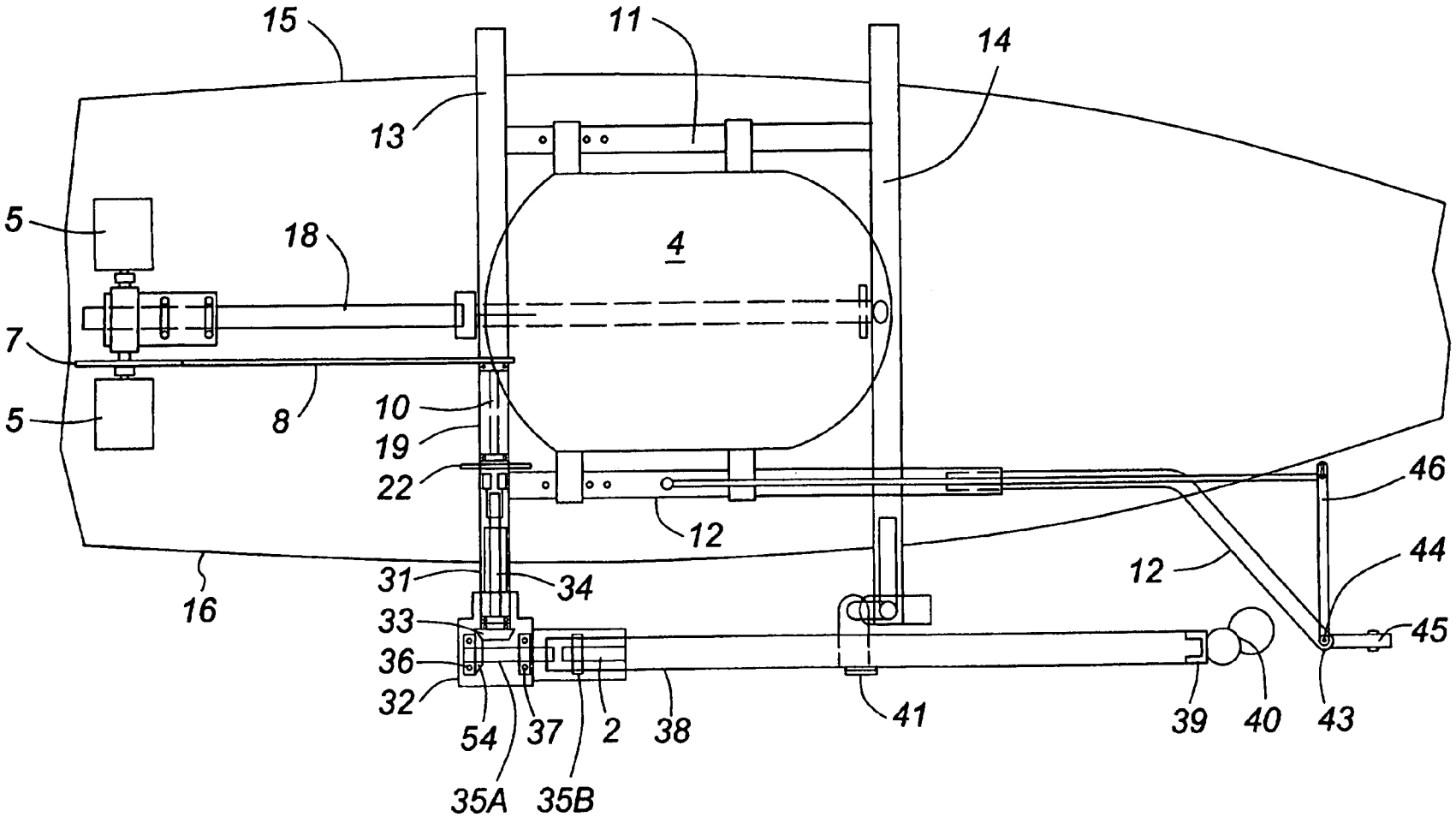
FIG. 5 is a top plan view of the embodiment shown in FIG. 1.
Figure 6:
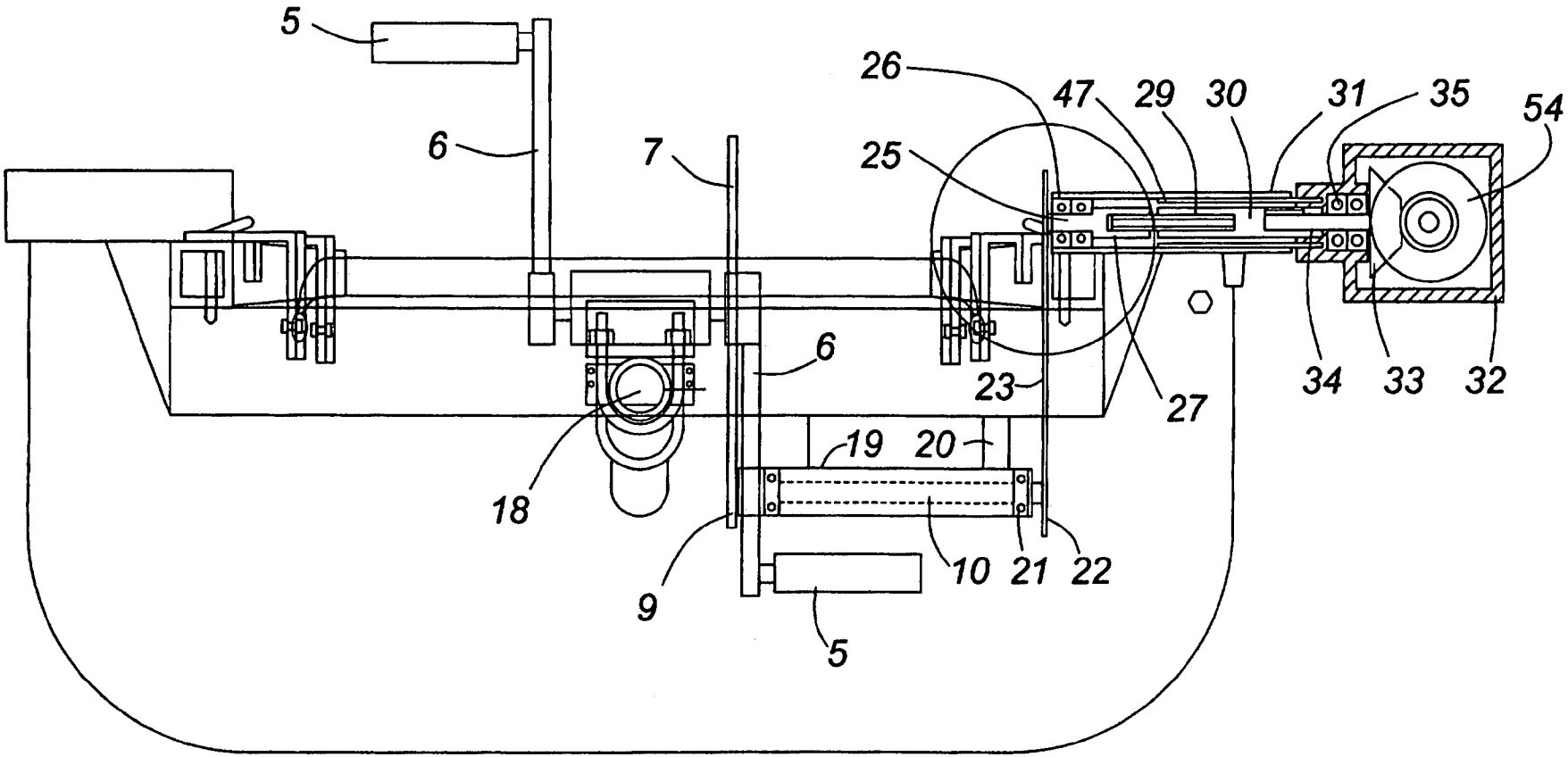
FIG. 6 is a front plan view of the embodiment shown in FIG. 1.
Figure 7:
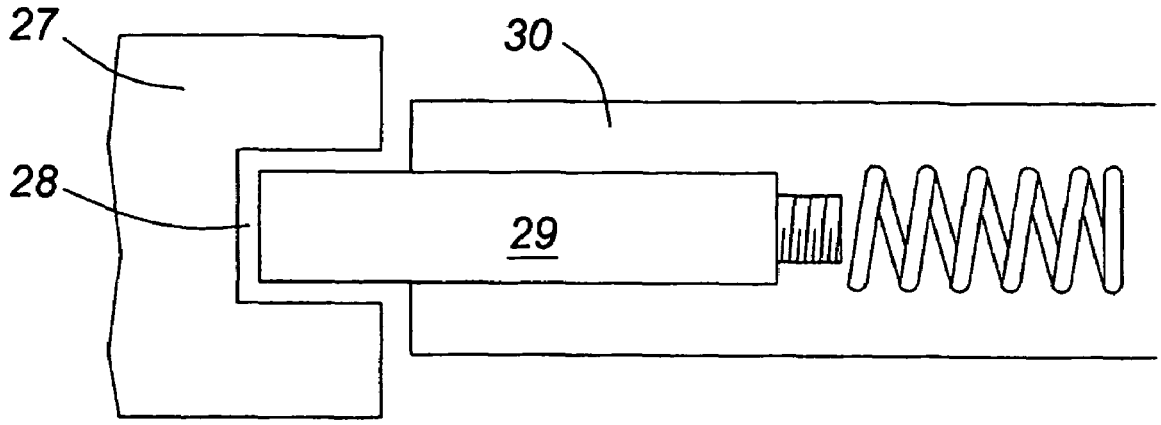
FIG. 7 is an enlarged detail view of the drive shaft shown in FIG. 6 in the engaged position.
Figure 8:
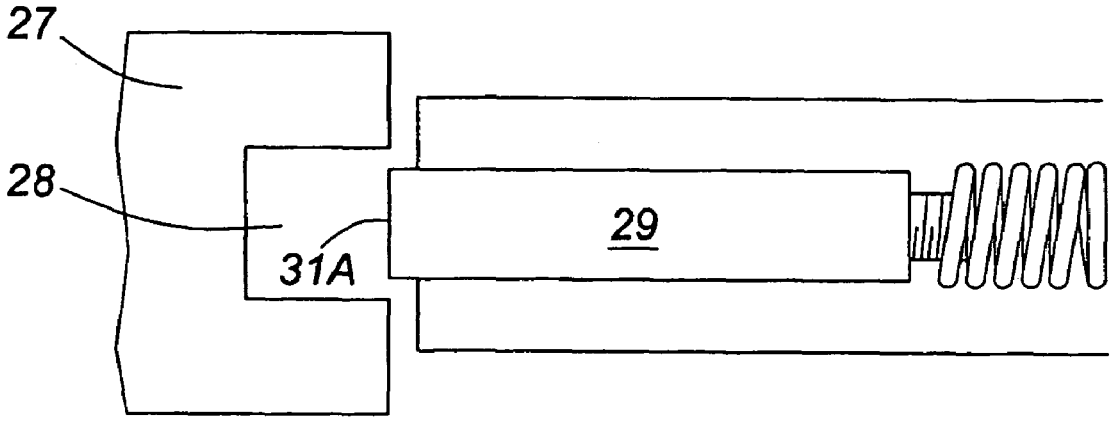
FIG. 8 is an enlarged detail view of the drive shaft shown in FIG. 6, in the disengaged position.
Figure 9:
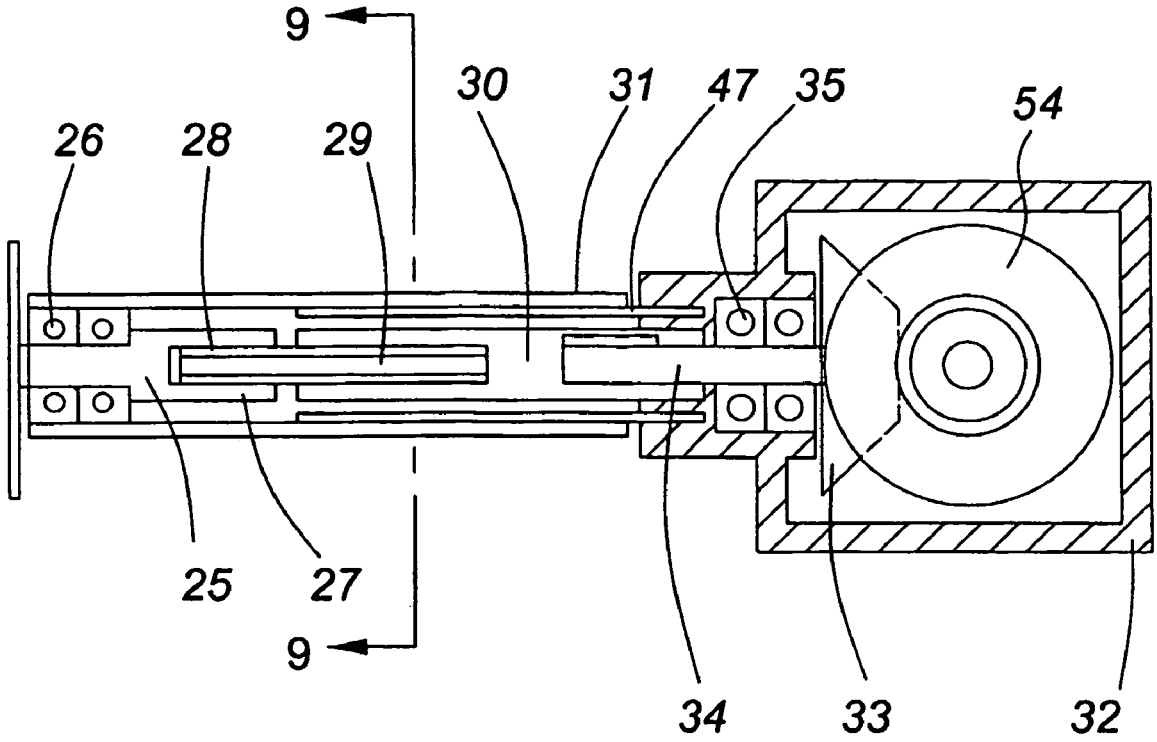
FIG. 9 is an enlarged view of part of FIG. 6.
Figure 11:
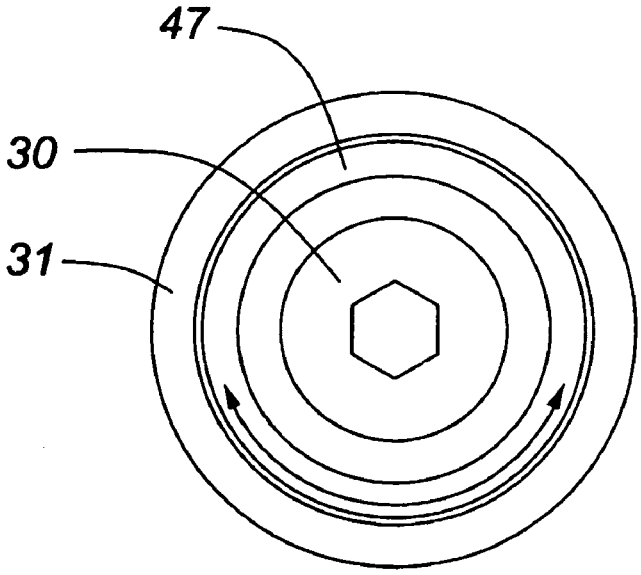
FIG. 11 is a sectional view of FIG. 9 taken along line 9-9.
Figure 10:
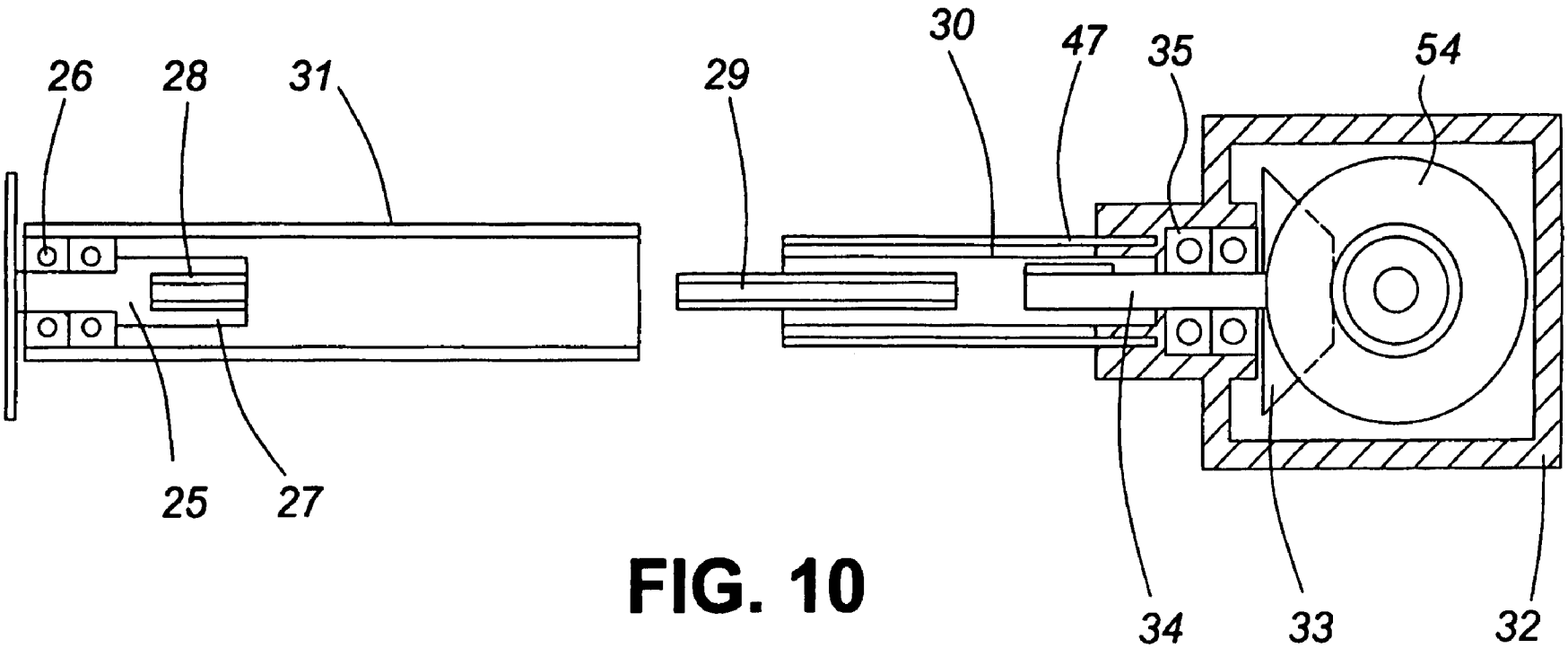
FIG. 10 is an exploded view of FIG. 9.

In FIG. 1 there is shown an isometric side view of one embodiment of the present invention with the drive shaft 2 (enclosed within tubular casing 38) in the angled, or lowered, position along the side of the canoe 1 upon which the device has been placed and rests on the gunwales thereof. As seen most clearly in FIG. 5, a quadrilateral frame comprising a pair of parallel, longitudinally extending, tubular members 11,12 and a pair of parallel, transversely extending members 13,14, rests on the gunwales 15,16 of canoe 1, either in front of or behind the central thwart 17 thereof and supports seat 4, preferably but not essentially adjustably, therebetween. It has been found that clamps, bolts or the like are not required to secure the frame to the canoe, but preferably the ends of transverse members are covered with a non-slip material, such as rubber, to provide additional grip and to reduce slippage. As seen in FIG. 1, a canoe operator 3, seated on seat 4 propels the canoe 1 by means of pedals 5 and cranks 6, mounted on a tubular member 18 forwardly of the quadrilateral frame on the longitudinal centre line and near the bottom of the canoe. Pedals 5 and cranks 6 are operatively mounted on toothed sprocket 7 which drives endless chain 8. Chain 8 is operatively connected to rear sprocket 9, mounted for rotation about a horizontal transverse axis on a lower transverse drive shaft 10, contained within drive tube 19 which is supported by a tubular member 20 depending from transverse tubular member 13. The outer end of shaft 10 is supported by bearing 21 and terminates in a sprocket 22 to drive endless chain 23 and sprocket 24. Sprocket 24 is mounted to one end of a transverse drive shaft 25 which in turn is rotatably mounted in bearing 26 on transverse member 13 at a level slightly above gunwale 16. The outboard end of shaft 25 is provided with a hub 27 having a hexagonal axial bore 28 therein. A spring loaded hexagonal shaft 29 is slideably mounted in an axial bore of a drive shaft 30 so that an end 31A of shaft 29 can releasably engage in bore 28, as seen in FIG. 7. Shaft 30 is rotatably mounted within a tubular housing 31 and axially moveable so as to disengage shaft 29 when required and to align spring-loaded shaft 29 with bore 28 so as to engage therewith, one end of which supports bearing 26 and the other end of which rotatably supports gear box housing 32. A bevel gear 33, contained within housing 32, is splined to a shaft 34, rotatably supported by bearing 35, which is in turn axially splined to shaft 30. Bevel gear 33 operatively engages bevel gear 54, also contained within housing 32, axially mounted on an output shaft 35A which is supported by bearings 36,37 within housing 32 and connected to propeller drive shaft 2. Propeller drive shaft 2 is supported by bearing 35B, and is contained within tubular casing 38. A cutlass bearing 39 is provided at the lower end of tubular casing 38 to support propeller drive shaft 2 adjacent a propeller 40. It will be appreciated that shaft 2 and tubular casing 38 can be moved in a vertical plane by rotating gear box housing 32 and tube 47 secured thereto and extending along a horizontal transverse axis inside housing 31, so that shaft 2 can be raised to a horizontal, inoperative, position parallel the gunwale 16 in which propeller 40 is raised out of the water, and lowered to an angled, operative, position as seen in FIG. 4, in which the propeller 40 is below the water level. Preferably, tubular casing 38 is supported, intermediate the ends thereof by either a hanger 41 adjustably suspended from transverse member 14 or a hanger 42 suspended from transverse member 14, so as to retain tubular casing 38 in the operative position or the inoperative position as selected by the operator simply by reaching over the side of the canoe and without needing to turn or reach towards the stern of the canoe.

As seen in FIGS. 2, 3, 4 and 5, longitudinal member 12 is somewhat longer than longitudinal member 11 and is angled outwardly at the stern end thereof to support a rudder post housing 43, vertical rudder post 44 and rudder 45. A control arm 46 is mounted on rudder post 44, perpendicular to rudder 45, and pivotally mounted to a control rod or tiller 47A for operation by operator 3 to steer the canoe. Preferably, but not essentially, rudder 45 is axially aligned with propeller 40.

An alternate embodiment of the invention is also envisioned, wherein the motive power generated by the pedal crank is transmitted to the propeller drive shaft by means of a flexible cable-drive shaft, as described in the following.

The flexible cable-drive shaft embodiment of the invention is illustrated in FIGS. 12 to 16, and comprises a frame structure similar to that illustrated in FIGS. 1 to 11. As shown in FIG. 12, the apparatus comprises a quadrilateral frame comprising a pair of parallel, longitudinally extending, tubular members 11,12 and a pair of parallel, transversely extending members 13,14. Transverse members 13,14 may both be adapted to rest on the gunwales 15,16 of canoe 1. Alternatively, as seen in FIG. 12, transverse member 13 may be truncated, with the forward portions of longitudinal members 11,12 engaging with the gunwales 15,16, respectively. The quadrilateral frame supports seat 4, optionally adjustably. As with the above-described embodiment, clamps, bolts or the like are not required to secure the frame to the canoe, although it is preferred for the ends of the transverse members and/or longitudinal members to be covered with a non-slip material, such as rubber, to provide additional grip and to reduce slippage with the gunwales 15,16.

In operation, the canoe operator 3, seated on seat 4, propels the canoe 1 by means of pedals 5 and cranks 6, which are mounted on tubular member 18 forwardly of the quadrilateral frame on the longitudinal centre line and near the bottom of the canoe. Pedals 5 and cranks 6 are operatively mounted on toothed sprocket 7, which drives endless chain 8. Chain 8 is operatively connected to rear sprocket 9, mounted for rotation about a horizontal transverse axis on a transverse drive shaft 60. Transverse drive shaft 60 is supported by bearings 61,62, and terminates at a hub 63 formed at the outboard end thereof. Hub 63 has an axial bore 64 formed therein having a substantially square cross-section of dimensions effective to receive the typical square male end 68 of a conventional flexible cable-drive shaft 67.

Flexible cable-drive shafts are commonly known and used in the art of power transmission to couple a primary drive to a secondary drive or actuator along a curved, circuitous, or dynamically moving path. As used herein, the flexible cable-drive shaft may be unidirectional, although bidirectional flexible cable-drive shafts are preferred in order to facilitate forward and reverse propulsion of the watercraft.

Transverse drive shaft 60 is contained within a stationary drive tube 65, upon which is mounted a spring-loaded securing pin 66 for removable securement of the input end housing 69 of the flexible cable-drive shaft 67. Upon connecting the flexible cable-drive shaft 67 to the transverse drive shaft, securing pin 66 is forced through a hole in the stationary drive tube 65 by the spring action of spring 70, and into a corresponding locking recess 71 formed in the input end housing 69 of the flexible cable-drive shaft 67. The securing pin 66 thus retains the input end housing 69 within the stationary drive tube 65 during operation, and prevents rotational movement thereof upon rotation of the transverse drive shaft 60. Accordingly, rotation of the transverse drive shaft 60 causes corresponding rotation of the flexible cable 72 within flexible cable-drive shaft 67.

Figure 13:
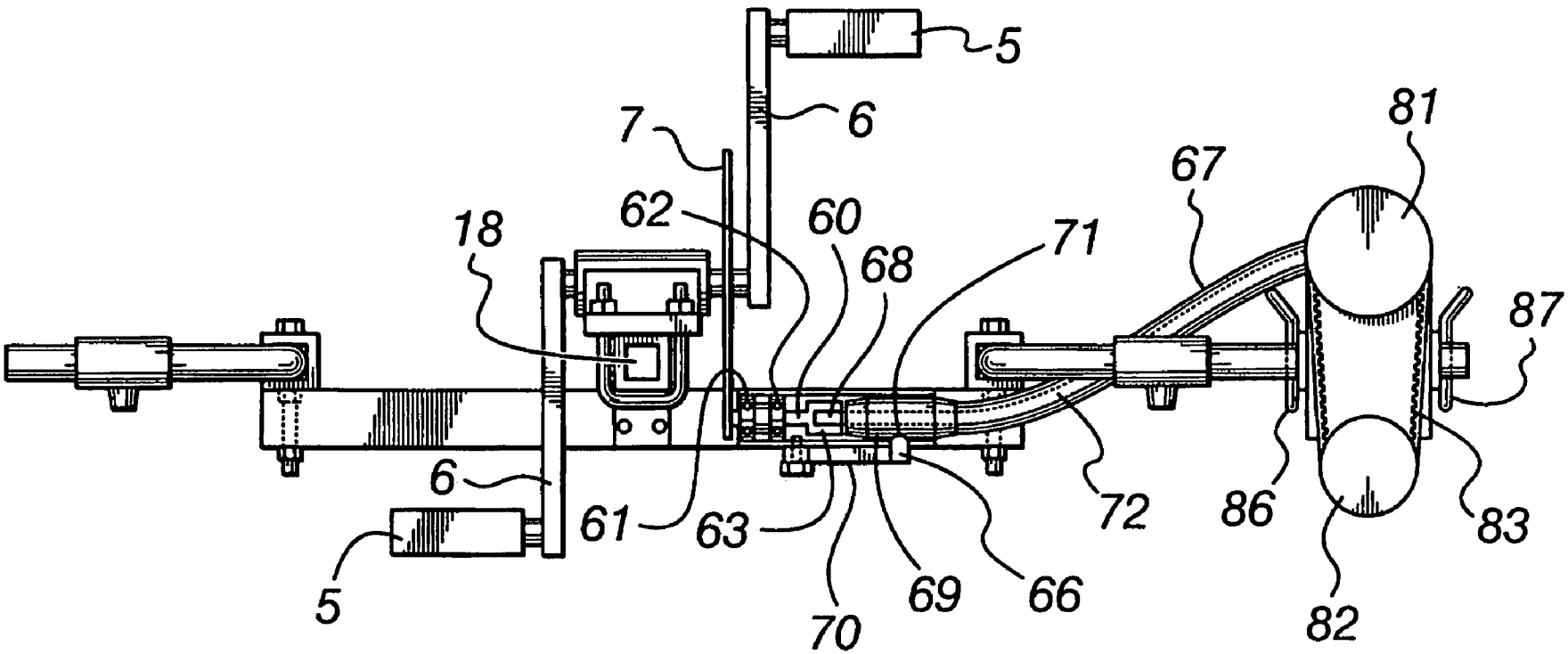
FIG. 13 is a front plan view of the embodiment of the invention shown in FIG. 12.
Figure 15:
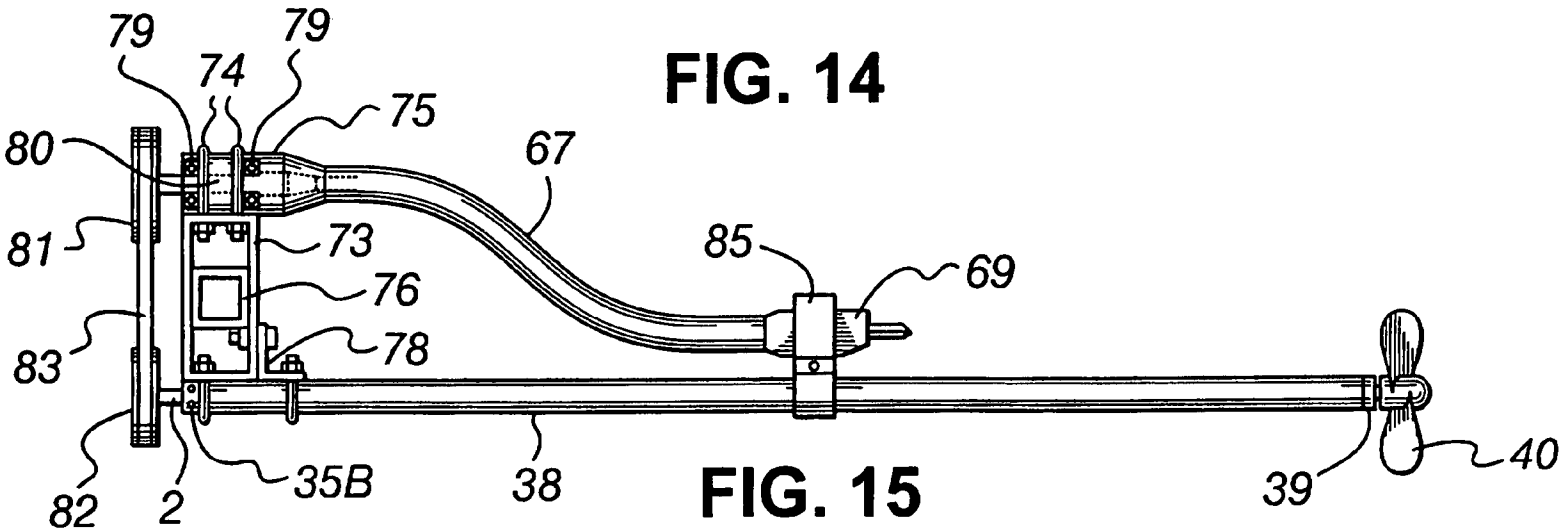
FIG. 15 is a side plan view of the drive shaft assembly of the embodiment of the invention shown in FIG. 12, removed from the main apparatus.

The outboard end of flexible cable 72 within flexible cable-drive shaft 67 is operably connected to a pulley system adapted to transfer power from the cable-drive shaft 67 to the propeller drive shaft 2. FIGS. 13 and 15 illustrate the aforementioned pulley system, in which the output end housing 75 of flexible cable-drive shaft 67 is attached to a support frame 73 by means of two U-bolts 74. Support frame 73 is mounted on square tube 76 which, as depicted in greater detail in FIG. 16, rides on and facilitates rotation about a round fixed tube 77 mounted at the forward end of longitudinal tubular member 12. The output end housing 75 includes drive shaft bearings 79 which support the flexible cable 72 at its outboard terminal end 80. Terminal end 80 is operably connected to drive-shaft pulley 81 such that rotation of the flexible cable 72 causes corresponding rotation of the drive-shaft pulley 81. Power from the drive-shaft pulley 81 is transmitted to a propeller shaft pulley 82 by means of a notch belt 83. Propeller shaft pulley 82 is operably connected to propeller drive shaft 2, which is supported by bearing 35B and is contained within tubular casing 38. Cutlass bearing 39 is provided at the lower end of tubular casing 38 to support propeller drive shaft 2 adjacent propeller 40. Tubular casing 38 is advantageously secured to support frame 73, as well as to an angle bracket 78 affixed thereto, by two or more U-bolts.

Figure 16:
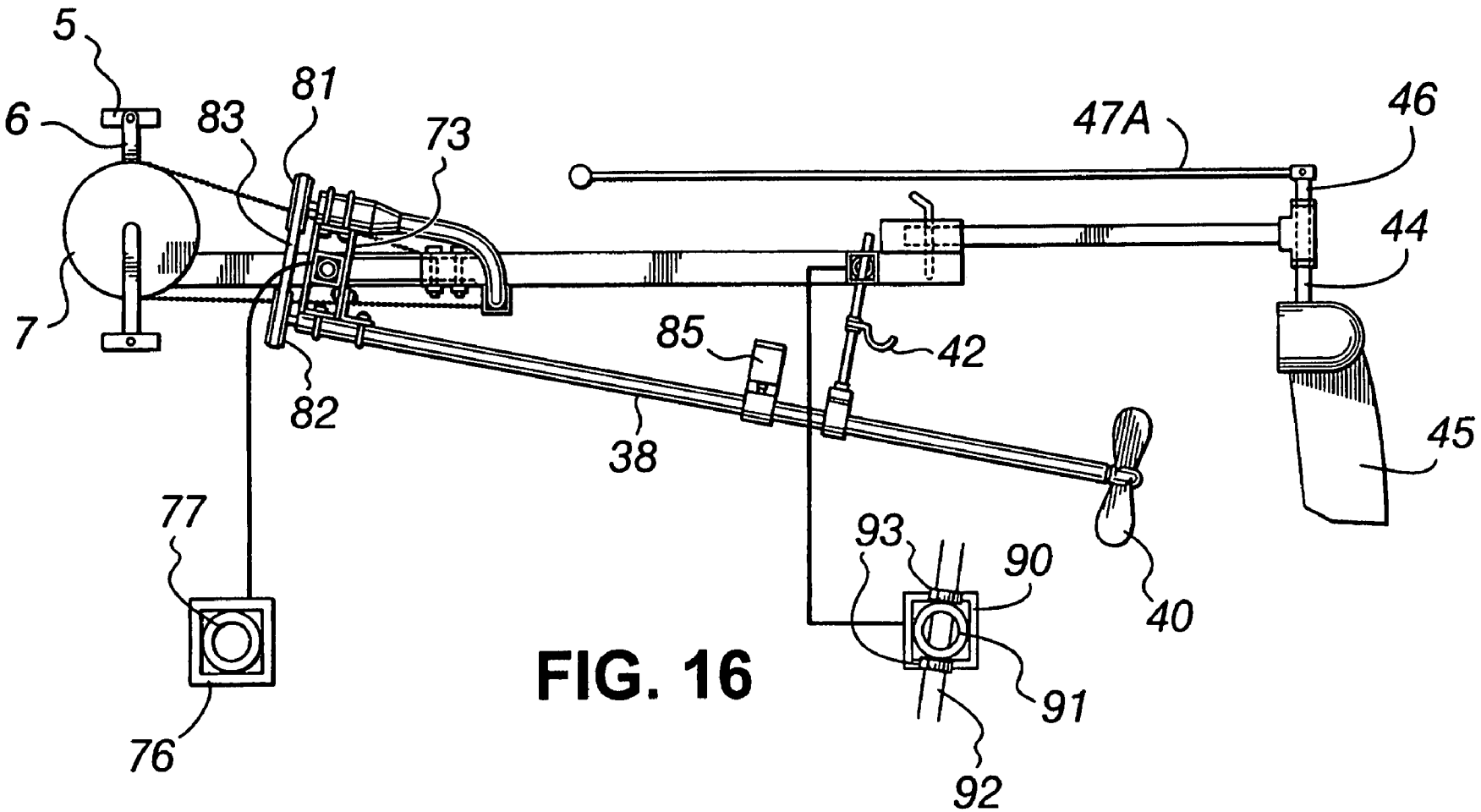
FIG. 16 is a side plan view of the embodiment of the invention shown in FIG. 12.

Propeller drive shaft 2 and tubular casing 38 can be moved in a vertical plane by rotating support frame 73 and square tube 76 about round fixed tube 77, such that propeller drive shaft 2 can be raised to a horizontal, inoperative, position parallel the gunwale 16 in which propeller 40 is raised out of the water, and lowered to an angled, operative, position as seen in FIG. 16, in which the propeller 40 is below the water level. As described for the first embodiment, tubular casing 38 is supported, intermediate the ends thereof by either hanger 41 adjustably suspended from transverse member 14 or by hanger 42 suspended from transverse member 14, SO as to retain tubular casing 38 in the operative position or the inoperative position as selected by the operator simply by reaching over the side of the canoe and without needing to turn or reach towards the stern of the canoe.

One possible mechanism for suspending hangers 41,42 from transverse member 14 is illustrated in detail in FIG. 16, wherein hanger 41 is secured to the lower end of a threaded rod 92, and hanger 42 is secured intermediate the upper and lower ends thereof, preferably adjustably. The threaded rod 92 is inserted through a hole formed in a round tube 91, and secured thereto by nuts 93. Round tube 91 is rotatably secured within the interior of a square tube 90, which is, in turn, secured to transverse member 14. Accordingly, the position of hanger 42 may be adjusted along substantially the entire length of threaded rod 92, and will preferably be rotatable thereabout. Moreover, by adjusting the position of nuts 93, which secure threaded rod 92 to round tube 91, the position of hanger 41 may be optimized based on the dimensions of the watercraft.

The flexible cable drive shaft 67 is detachable from the hub 63 of transverse drive shaft 60, as described above. For storage, the input end housing 69 is retracted from the stationary drive tube 65 with sufficient force to release the spring-loaded securement pin 66 from locking recess 71. Input end housing 69 may then be conveniently secured to a clamp 85, advantageously affixed to the tubular casing 38 intermediate the ends thereof.

Figure 14:
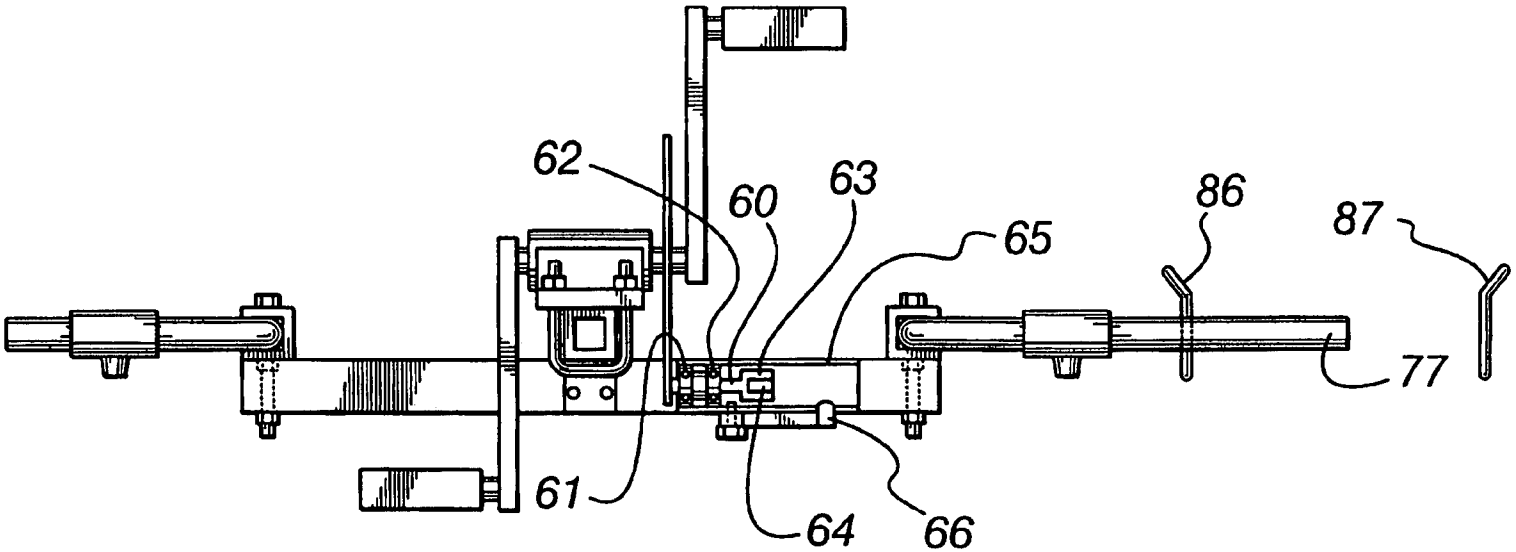
FIG. 14 is a front plan view of the embodiment of the invention shown in FIG. 12, with the drive shaft assembly removed from the main apparatus.

The propeller drive shaft assembly is also removable from the quadrilateral frame, as shown in FIGS. 13, 14 and 15. The support frame 73 and square tube 76 are detachably and rotatably secured to round fixed tube 77 by inner and outer pins 86,87. Pins 86,87 are inserted into holes formed in the round fixed tube 77 on either side of the support frame 73 and square tube 76, securing support frame 73 and square tube 76 to round fixed tube 77 such that rotational movement is permitted, while restricting sliding movement along the transverse axis of the round fixed tube 77. Upon removing outer pin 87, the entire propeller shaft assembly may be removed from the quadrilateral frame by sliding the support frame 73 and square tube 76 outwardly from the round fixed tube 77. This feature is particularly evident from FIG. 14, which shows the quadrilateral frame apart from the propeller shaft assembly.

As described for the first embodiment, longitudinal member 12 is somewhat longer than longitudinal member 11 and is angled outwardly towards the stern end thereof to support a rudder post housing 43, vertical rudder post 44 and rudder 45. A control arm 46 is mounted on rudder post 44, perpendicular to rudder 45, and pivotally mounted to a control rod or tiller 47A for operation by operator 3 to steer the canoe. Preferably, but not essentially, rudder 45 is axially aligned with propeller 40.

It will be appreciated that many modifications may be made without departing from the spirit and scope of this invention as defined by the appended claims. For example, the conventional toothed sprockets 7,9,22 and 24 may, if desired be replaced with similarly conventional smooth pulley wheels with associated ribbed or plain rubber drive belts or chains.

INDUSTRIAL APPLICABILITY

The invention described herein provides an improved propulsion apparatus for use with a small watercraft, such as a canoe. By providing an outboard propeller drive shaft pivotally mounted alongside the watercraft in close proximity to the operator, the apparatus enables the operator to raise and lower the propeller without the need to move from his seat or turn to face the rear of the watercraft, as required in propulsion systems commonly known in the art. Accordingly, the invention provides a pedal-operated propulsion system which is flexible and easy-to-use.

I claim:

1. A portable, pedal driven propeller and drive shaft apparatus for use in a watercraft having gunwales, comprising:

(a) a substantially quadrilateral frame adapted to be simply placed across the gunwales of the watercraft without needing clamps, bolts or other devices to secure it in place;

(b) operator seat means mounted on said quadrilateral frame;

(c) pedal crank means mounted forwardly of, and depending from, said quadrilateral frame and operable by an operator sitting on said seat means;

(d) pulley means pivotally mounted on said quadrilateral frame so as to lie to one side of the operator seat means and forward thereof when in the operative position;

(e) means to transmit motive power generated by said pedal crank means to said pulley means, said means to transmit motive power comprising drive means, a transverse drive shaft and flexible cable-drive means, said drive means being operatively connected to said pedal crank means and to a first end of the transverse drive shaft, and said flexible cable-drive means being operatively connected at a first end thereof to a second end of said transverse drive shaft, and, at a second end thereof, to said pulley means; and (f) longitudinal drive shaft means comprising a longitudinal shaft operatively connected at a first end thereof to said pulley means and, at a second end thereof, to propeller means backward of the operator seat means toward the back end of the watercraft; said pulley means and longitudinal drive shaft means being adapted to be pivoted, when mounted on said watercraft, about a horizontal transverse axis so as to raise said propeller means to an inoperable position wherein said longitudinal drive shaft means is substantially parallel to said gunwales, and lower said propeller means to an operative position wherein said longitudinal drive shaft means is at an acute angle relative to said gunwales, wherein said pulley means and said longitudinal drive shaft means are mounted to and supported by a frame secured to and rotatable about a round tube portion of said quadrilateral frame, wherein said frame comprises a square tube having internal dimensions slightly greater than outer dimensions of said round tube portion, said square tube being slidable with said round tube portion, and detachably secured thereto by removable pins positioned immediately adjacent said frame on an outboard side thereof.

2. A portable, pedal driven propeller and drive shaft apparatus for use in a watercraft having gunwales, comprising:

(a) a substantially quadrilateral frame adapted to be simply placed across the gunwales of the watercraft without needing clamps, bolts or other devices to secure it in place;

(b) operator seat means mounted on said quadrilateral frame;

(c) pedal crank means mounted forwardly of, and depending from, said quadrilateral frame and operable by an operator sitting on said seat means;

(d) pulley means pivotally mounted on said quadrilateral frame so as to lie to one side of the operator seat means and forward thereof when in the operative position;

(e) means to transmit motive power generated by said pedal crank means to said pulley means, said means to transmit motive power comprising drive means, a transverse drive shaft and flexible cable-drive means, said drive means being operatively connected to said pedal crank means and to a first end of the transverse drive shaft, and said flexible cable-drive means being operatively connected at a first end thereof to a second end of said transverse drive shaft, and, at a second end thereof, to said pulley means; and (f) longitudinal drive shaft means comprising a longitudinal shaft operatively connected at a first end thereof to said pulley means and, at a second end thereof, to propeller means backward of the operator seat means toward the back end of the watercraft; said pulley means and longitudinal drive shaft means being adapted to be pivoted, when mounted on said watercraft, about a horizontal transverse axis so as to raise said propeller means to an inoperable position wherein said longitudinal drive shaft means is substantially parallel to said gunwales, and lower said propeller means to an operative position wherein said longitudinal drive shaft means is at an acute angle relative to said gunwales, wherein said pulley means is mounted on said quadrilateral frame so as to lie outboard of one of said gunwales when in the operative position.

3. A portable, pedal driven propeller and drive shaft apparatus for use in a watercraft having gunwales, comprising:

(a) a substantially quadrilateral frame adapted to be simply placed across the gunwales of the watercraft without needing clamps, bolts or other devices to secure it in place;

(b) operator seat means mounted on said quadrilateral frame;

(c) pedal crank means mounted forwardly of, and depending from, said quadrilateral frame and operable by an operator sitting on said seat means;

(d) pulley means pivotally mounted on said quadrilateral frame so as to lie to one side of the operator seat means and forward thereof when in the operative position;

(e) means to transmit motive power generated by said pedal crank means to said pulley means, said means to transmit motive power comprising drive means, a transverse drive shaft and flexible cable-drive means, said drive means being operatively connected to said pedal crank means and to a first end of the transverse drive shaft, and said flexible cable-drive means being operatively connected at a first end thereof to a second end of said transverse drive shaft, and, at a second end thereof, to said pulley means; and (f) longitudinal drive shaft means comprising a longitudinal shaft operatively connected at a first end thereof to said pulley means and, at a second end thereof, to propeller means backward of the operator seat means toward the back end of the watercraft; said pulley means and longitudinal drive shaft means being adapted to be pivoted, when mounted on said watercraft, about a horizontal transverse axis so as to raise said propeller means to an inoperable position wherein said longitudinal drive shaft means is substantially parallel to said gunwales, and lower said propeller means to an operative position wherein said longitudinal drive shaft means is at an acute angle relative to said gunwales, wherein said transverse drive shaft is rotatably mounted in transverse tube means mounted on said quadrilateral frame, wherein said transverse tube means comprises a spring-loaded pin mounted thereon and in alignment with a corresponding hole formed therein, the pin being of sufficient dimensions to engage with a locking recess formed in an input end housing of the flexible cable-drive means and limiting translational and rotational movement thereof upon rotation of said transverse drive shaft.

4. A portable, pedal driven propeller and drive shaft apparatus for use in a watercraft having gunwales, comprising:

(a) a substantially quadrilateral frame adapted to be simply placed across the gunwales of the watercraft without needing clamps, bolts or other devices to secure it in place;

(b) operator seat means mounted on said quadrilateral frame;

(c) pedal crank means mounted forwardly of, and depending from, said quadrilateral frame and operable by an operator sitting on said seat means;

(d) pulley means pivotally mounted on said quadrilateral frame so as to lie to one side of the operator seat means and forward thereof when in the operative position;

(e) means to transmit motive power generated by said pedal crank means to said pulley means, said means to transmit motive power comprising drive means, a transverse drive shaft and flexible cable-drive means, said drive means being operatively connected to said pedal crank means and to a first end of the transverse drive shaft, and said flexible cable-drive means being operatively connected at a first end thereof to a second end of said transverse drive shaft, and, at a second end thereof, to said pulley means; and (f) longitudinal drive shaft means comprising a longitudinal shaft operatively connected at a first end thereof to said pulley means and, at a second end thereof, to propeller means backward of the operator seat means toward the back end of the watercraft; said pulley means and longitudinal drive shaft means being adapted to be pivoted, when mounted on said watercraft, about a horizontal transverse axis so as to raise said propeller means to an inoperable position wherein said longitudinal drive shaft means is substantially parallel to said gunwales, and lower said propeller means to an operative position wherein said longitudinal drive shaft means is at an acute angle relative to said gunwales, wherein said pulley means comprises a first pulley operably connected to the second end of said flexible cable-drive means, a second pulley operably connected to the first end of said longitudinal shaft, and an endless drive belt for transmission of power from said first pulley to said second pulley.

* * * * *